US006764611B2

(12) United States Patent
Poirier

(10) Patent No.: US 6,764,611 B2
(45) Date of Patent: Jul. 20, 2004

(54) SERVO VALVE EROSION INHIBITED AIRCRAFT HYDRAULIC FLUIDS

(75) Inventor: Marc-André Poirier, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 329 days.

(21) Appl. No.: 10/077,607

(22) Filed: Feb. 15, 2002

(65) Prior Publication Data

US 2002/0179882 A1 Dec. 5, 2002

Related U.S. Application Data

(60) Provisional application No. 60/285,106, filed on Apr. 20, 2001.

(51) Int. Cl.[7] ..... C09K 5/00
(52) U.S. Cl. ..... 252/73
(58) Field of Search ..... 252/73

(56) References Cited

U.S. PATENT DOCUMENTS 4,371,447 A * 2/1983 Webb et al. ..... 252/73
4,469,611 A * 9/1984 Snyder et al. ..... 252/75

* cited by examiner

*Primary Examiner*—Hoa Van Le
(74) *Attorney, Agent, or Firm*—Joseph J. Dvorak

(57) ABSTRACT

Phosphate ester based functional fluids containing novel anti-erosion additives provides enhanced results in erosion control.

6 Claims, No Drawings

SERVO VALVE EROSION INHIBITED AIRCRAFT HYDRAULIC FLUIDS

CROSS REFERENCE TO RELATED APPLICATION

This application claims the benefit of U.S. Provisional Application 60/285,106 filed Apr. 20, 2001

FIELD OF THE INVENTION

This invention relates to phosphate ester fluids used in transmitting power in hydraulic systems. More specifically it relates to enhancing the anti-erosion properties of such fluids.

BACKGROUND OF THE INVENTION

Functional fluids are used in a wide variety of industrial applications. For example they are used as the power transmitting medium in hydraulic systems, such as aircraft hydraulic systems.

Functional fluids intended for use in aircraft hydraulic systems must meet stringent performance criteria such as thermal stability, fire resistance, low susceptibility to viscosity changes over a wide range of temperatures, good hydrolytic stability, elastomer compatibility and good lubricity.

Organic phosphate ester fluids have been recognized as a preferred fluid for use as a functional fluid such as in hydraulic fluids. Indeed, in present commercial aircraft hydraulic fluids phosphate esters are among the most commonly used base stocks.

As with other functional fluids, organic phosphate ester based fluids require the incorporation of various additives to enhance the performance of the fluid. For example, experience has shown that orifices in the servo control valves of aircraft hydraulic systems are subject to erosion which is attributed to streaming current induced by fluid flow. Valve orifice erosion, if extensive, can greatly impair the functioning of the valve as a precise control mechanism. Therefore various additives have been used in functional fluids as erosion inhibitors. Nonetheless, there remains a need for increased choice of useful erosion inhibitors, especially for improved erosion inhibitors.

One object of the present invention is to provide phosphate ester based aircraft hydraulic fluids with enhanced anti-erosion properties.

SUMMARY OF THE INVENTION

Briefly stated a phosphate ester functional fluid, especially a hydraulic fluid, is enhanced by incorporating in the fluid an erosion inhibiting an erosion inhibiting amount of an additive or mixture thereof having the formula $$R_fCH_2CH_2SO_3M$$

where $R_f$=$F(CH_2CF_2)_y$, y=1 to about 9 and M is an alkali metal selected from lithium, sodium, potassium, rubidium or ceasium. M can also be a quaternary ammonium cation having following formula RR'R"R'"N⊕ wherein R, R', R", R'" are independently hydrogen, hydrocarbyl groups of from 1 to 30 carbon atoms and oxygen containing hydrocarbyl groups of from 1 to 25 carbon atoms.

DETAILED DESCRIPTION OF THE INVENTION

The anti-erosion properties of phosphate ester based functional fluids, especially aircraft hydraulic fluids, are enhanced by adding to the fluid an effective amount of a salt or mixture of salts represented by the formula $$R_fCH_2CH_2SO_3M$$

where $R_f$=$F(CH_2CF_2)_y$, y=1 to about 9 and M is an alkali metal selected from lithium, sodium, potassium, rubidium or ceasium. M can also be a quaternary ammonium cation having following formula RR'R"R'"N⊕ (wherein R, R', R", R'" are independently hydrogen, hydrocarbyl groups of from 1 to 30 carbon atoms and oxygen containing hydrocarbyl groups of from 1 to 25 carbon atoms.

The foregoing additives are readily prepared by neutralization of the corresponding acid (i.e., a compound of the above formula except that M is H) with an alkali metal hydroxide or quaternary ammonium hydroxide. Additives of the foregoing formula are also commercially available compounds.

The anti-erosion additive is incorporated in the phosphate ester basestock in an amount sufficient to enhance the anti-erosive properties of the fluid. Typically the addition comprises from about 0.01 wt % to about 0.5 wt % based on the weight of the basestock.

Phosphate ester base stocks used in this invention refer to organo-phosphate esters selected from trialkyl phosphate, dialkyl aryl phosphate, alkyl diaryl phosphate and triaryl phosphate that contain from 3 to 8, preferably from 4 to 5 carbon atoms. Suitable phosphate esters useful in the present invention include, for example, tri-n-butyl phosphate, tri-isobutyl phosphate, n-butyl di-isobutyl phosphate, di-isobutyl n-butyl phosphate, n-butyl diphenyl phosphate, isobutyl diphenyl phosphate, di-n-butyl phenyl phosphate, di-isobutyl phenyl phosphate, tri-n-pentyl phosphate, tri-isopentyl phosphate, triphenyl phosphate, isopropylated triphenyl phosphates, and butylated triphenyl phosphates. Preferably, the trialkyl phosphate esters are those of tri-n-butyl phosphate and tri-isobutyl phosphate.

The amounts of each type of phosphate ester in the hydraulic fluid can vary depending upon the type of phosphate ester involved. The amount of trialkyl phosphate in the base stock fluid comprises from about 10 wt % to about 100 wt % preferably from about 20 wt % to about 90 wt %. The amount of dialkyl aryl phosphate in the base stock fluid is typically from 0 wt % to 75 wt % preferably from 0 wt % to about 50 wt %. The amount of alkyl diaryl phosphate in the base stock fluid is typically from 0 wt % to 30 wt %, preferably from 0 wt % to 10 wt %. The amount of triaryl phosphate in the base stock fluid is typically from 0 wt % to 20 wt % and preferably from 0 wt % to 15 wt %.

The hydraulic fluids of this invention contain from 1 wt % to 20 wt % based on total weight composition of additives selected from one or more antioxidants, acid scavengers, VI improvers, rust inhibitors, defoamers. The use of those conventional additives provides satisfactory hydrolytic, oxidative stability and viscometric properties of the hydraulic fluid compositions under normal and severe conditions found in aircraft hydraulic systems.

Antioxidants useful in hydraulic fluid compositions in this invention include, for example, polyphenols, trialkylphenols and di (alkylphenyl) amines, examples of which include bis (3,5-di-tert-butyl-4-hydroxyphenyl) methane, 1,3,5-trimethyl-2,4,6-tris (3,5-di-tert-butyl-4-hydroxyphenyl) benzene, 2,6-di-tert-butyl-4-methylphenol, tetrakis (methylene (3,5-di-tert-butyl-4-hydroxy-hydrocinnamate) methane, and di (n-octylphenyl) amine. Typical amounts for each type of antioxidants can be from about 0.1 wt % to 2 wt %.

Acid scavengers useful in hydraulic fluid compositions of this invention to neutralize phosphoric acid and dialkyl phosphoric acid produced from the hydrolysis and thermal degradation of the phosphate ester base stocks. Examples of acid scavengers include epoxy compounds such as epoxycyclo-hexane carboxylates. Typical amounts that can be used as acid scavenger can be from about 1 to about 10 wt % based on the total weight of hydraulic fluid.

EXAMPLE 1

This example illustrates the preparation of an additive of the present invention.

To 100 g of Zonyl® FS-62[1] in 750 ml methanol is added 13.1 g of KOH with stirring. The methanol is removed by flushing the solution with nitrogen at 40° C. The product salt is then dried in a vacuum oven at 70–80° C. for 24 hours.

[1] Zonyl® FS-62 is the tradename for a perfluoroalkylene sulfuric acid sold by Du Pont Inc., Wilmington, Del.

EXAMPLE 2

This example is presented to hypothetically illustrate making functional fluids containing an alkali metal salt of a perfluoroalkylethylene sulfonate. The following functional fluids can be prepared by incorporating the particular salt into a tributyl phosphate, triarylphosphate base oil containing conventional VI improver, epoxide acid scavenger, antioxidant rust inhibitor and difoamer.

TABLE 1

| Fluid | Additive Salt | Concentration, wt % |
|---|---|---|
| 1 | Potassium | 0.01 |
| 2 | Lithium | 0.5 |
| 3 | Rubidium | 0.01 |
| 4 | Cesium | 0.01 |
| 5 | Potassium | 0.5 |
| 6 | Lithium | 0.1 |
| 7 | Quarterny Ammonium | 0.05 |
| 8 | Ammonium | 0.03 |

What is claimed is:

1. A functional fluid comprising a phosphate ester basestock and a salt or mixture of salts represented by the formula $$R_fCH_2CH_2SO_3M$$

where $R_f$=$F(CH_2CF_2)_y$, y=1 to about 9 and M is an alkali metal selected from lithium, sodium, potassium, rubidium or ceasium and a quaternary ammonium cation having following formula RR'R"R'"N⊕ wherein R, R', R", R'" are independently hydrogen, hydrocarbyl groups of from 1 to 30 carbon atoms and oxygen containing hydrocarbyl groups of from 1 to 25 carbon atoms.

2. The fluid of claim 1 wherein the salt or mixture of salts comprises about 0.01 to about 0.5 wt % of the basestock.

3. The fluid of claim 2 wherein M is an alkali metal.

4. The fluid of claim 3 wherein M is potassium.

5. The method of inhibiting the erosion tendency of a phosphate ester based fluid comprising incorporating in the fluid from 0.01 to about 0.5 wt % of a compound or mixture of compounds represented by the formula $$R_fCH_2CH_2SO_3M$$

where $R_f$=$F(CH_2CF_2)_y$, y=1 to about 9 and M is an alkali metal selected from lithium, sodium, potassium, rubidium or ceasium and a quaternary ammonium cation having following formula RR'R"R'"N⊕ wherein R, R', R", R'" are independently hydrogen, hydrocarbyl groups of from 1 to 30 carbon atoms and oxygen containing hydrocarbyl groups of from 1 to 25 carbon atoms.

6. The method of claim 5 wherein M is an alkali metal.

* * * * *